US009060403B2

(12) United States Patent
Tseng

(10) Patent No.: US 9,060,403 B2
(45) Date of Patent: Jun. 16, 2015

(54) LIGHT EMITTING DIODE DRIVING APPARATUS AND LIGHT EMITTING DIODE BACKLIGHT SYSTEM USING THE SAME

(71) Applicant: Power Forest Technology Corporation, Hsinchu (TW)

(72) Inventor: Yang-Tai Tseng, Nantou County (TW)

(73) Assignee: Power Forest Technology Corporation, Hsinchu County (TW)

( * ) Notice: Subject to any disclaimer, the term of this patent is extended or adjusted under 35 U.S.C. 154(b) by 195 days.

(21) Appl. No.: 13/956,383

(22) Filed: Aug. 1, 2013

(65) Prior Publication Data

US 2014/0339993 A1 Nov. 20, 2014

(30) Foreign Application Priority Data

May 17, 2013 (TW) ..... 102117577 A

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |
| ***G09G 3/34*** | (2006.01) |

(52) U.S. Cl.

CPC ..... *H05B 33/0845* (2013.01); *G09G 3/3426* (2013.01)

(58) Field of Classification Search

USPC ..... 315/64, 193, 313

See application file for complete search history.

(56) References Cited

U.S. PATENT DOCUMENTS

| | | | | |
|---|---|---|---|---|
| 2011/0069094 | A1* | 3/2011 | Knapp | 345/690 |
| 2011/0074839 | A1* | 3/2011 | Liu et al. | 345/690 |
| 2012/0299484 | A1* | 11/2012 | Shin | 315/122 |
| 2013/0063036 | A1* | 3/2013 | Li | 315/192 |
| 2013/0162154 | A1* | 6/2013 | Lee et al. | 315/200 R |
| 2014/0292630 | A1* | 10/2014 | Zhang et al. | 345/102 |
| 2014/0339993 | A1* | 11/2014 | Tseng | 315/193 |
| 2014/0354168 | A1* | 12/2014 | Hyeon et al. | 315/209 R |

FOREIGN PATENT DOCUMENTS

| | | |
|---|---|---|
| TW | 201143514 | 12/2011 |
| TW | 201208466 | 2/2012 |
| TW | 201311045 | 3/2013 |

OTHER PUBLICATIONS

"Office Action of Taiwan Counterpart Application" , issued on Oct. 17, 2014, p. 1-p. 3.

* cited by examiner

*Primary Examiner* — Adam Houston
(74) *Attorney, Agent, or Firm* — Jianq Chyun IP Office

(57) ABSTRACT

A light emitting diode (LED) driving apparatus and an LED backlight system using the same are provided. The backlight control circuit suitable for driving an LED string includes a complex function pin, a driving circuit and a backlight control circuit. The backlight control circuit includes a control current generating unit, a first current comparing unit and a second current comparing unit. The control current generating unit receives a dimming control signal and an enable control signal from the complex function pin to generate a control current accordingly. The first and the second current comparing units are respectively configured to compare the control current with first and second predetermined currents to respectively generate a first and a second control signals. The driving circuit determines to be turned on or off according to the second control signal, and further adjusts a luminance of the LED string according to the first control signal.

18 Claims, 2 Drawing Sheets

LIGHT EMITTING DIODE DRIVING APPARATUS AND LIGHT EMITTING DIODE BACKLIGHT SYSTEM USING THE SAME

CROSS-REFERENCE TO RELATED APPLICATION

This application claims the priority benefit of Taiwan application serial no. 102117577, filed on May 17, 2013. The entirety of the above-mentioned patent application is hereby incorporated by reference herein and made a part of this specification.

BACKGROUND OF THE INVENTION

1. Field of the Invention

The invention relates to a light emitting diode driving technology, and more particularly, to a light emitting diode driving apparatus and a light emitting diode backlight system using the same.

2. Description of Related Art

Due to rapidly advancing semiconductor technologies in the recent years, portable electronics and flat panel displays have also gained popularity. Among various types of flat display panel, liquid crystal displays (LCDs) have gradually become the mainstream display products due to the advantages such as a low operating voltage, free of harmful radiation, light weight and small and compact size. In general, the LCD is not equipped with a self-luminance function, and thus a backlight module is required to be disposed underneath an LCD panel, so as to supply a light (backlight) source to the LCD panel.

A conventional backlight module can be roughly classified into two types, i.e. a cold cathode fluorescent lamp (CCFL) backlight module and a light emitting diode (LED) backlight module. Since the light emitting diode backlight module is capable of improving color gamut of the LCD, panel manufacturers prefer to employ the light emitting diode backlight module in replacement of the CCFL backlight module.

The light emitting diode backlight module generally includes a plurality of light emitting diode strings connected in parallel, and each light emitting diode string is composed by a plurality of light emitting diodes connected in series. In a conventional light emitting diode backlight system, a light emitting diode driving apparatus is generally composed by circuits such as a control chip, a power switch and a power conversion circuit. The control chip may provide a switching signal to switch the power switch, so that the power conversion circuit may generate a driving signal in response to switching of the power switch to drive the light emitting diode string, so as to turn on the light emitting diode string for emitting light.

Generally, the control chip may adjust the driving signal provided by itself according to various control signals, so as to realize control functions such as adjusting luminance of the backlight module and turning on or off the backlight module. However, to realize above control functions, in the conventional light emitting diode apparatus, the control chip at least require two different complex function pins to respectively receive the control signal for dimming and the control signal for controlling the backlight module to be turned on or off.

In an integrated circuit layout of the control chip with a fixed layout area, difficulty and complexity of circuit layout are relatively higher when a number of the complex function pins increases. In addition, in case of a tight layout space, a possibility that an unexpected coupling phenomenon to occur may also be significantly increased.

SUMMARY OF THE INVENTION

The invention is directed to a light emitting diode driving apparatus and a light emitting diode backlight system using the same, which are capable of controlling luminance and conductive state of light emitting diode by utilizing the same complex function pin.

The light emitting diode driving apparatus of the invention is suitable for driving at least one light emitting diode string. The light emitting diode driving apparatus includes a driving circuit and a backlight control circuit. The driving circuit is coupled to the light emitting diode string and configured to provide a driving signal to drive the light emitting diode string. The backlight control circuit is coupled to the complex function pin and the driving circuit, in which the backlight control circuit includes a control current generating unit, a first current comparing unit and a second current comparing unit. The control current generating unit receives a dimming control signal and an enable control signal from the complex function pin, and generates a control current in response to disable/enable states of the dimming control signal and the enable control signal. The first current comparing unit is coupled to the control current generating unit, and configured to compare the control current with a first predetermined current and generate a first control signal according to a comparison result. The second current comparing unit is coupled to the control current generating unit, and configured to compare the control current with a second predetermined current and generate a second control signal according to a comparison result, in which the first predetermined current is less than the second predetermined current. The driving circuit determines to be turned on or off according to the second control signal, so as to control whether to provide the driving signal. The driving circuit further adjusts the driving signal according to the first control signal, so as to adjust a luminance of the light emitting diode string.

In an embodiment of the invention, when the enable control signal is disabled, the control current generating unit generates the control current greater than or equal to the second predetermined current in response to the enable control signal, so that the driving circuit is turned off according to the second control signal and stops to provide the driving signal to turn off the light emitting diode string.

In an embodiment of the invention, when the enable control signal is enabled, the control current generating unit generates the control current less than the second predetermined current in response to the disable/enable state of the dimming control signal, so that the driving circuit is turned on according to the second control signal and provides the driving signal to turn on the light emitting diode string.

In an embodiment of the invention, when the dimming control signal is disabled, the control current generating unit generates the control current greater than or equal to the first predetermined current in response to the dimming control signal, so that the driving circuit adjusts the luminance of the light emitting diode string to a first luminance according to the first control signal.

In an embodiment of the invention, when the dimming control signal is enabled, the control current generating unit generates the control current less than the first predetermined current in response to the dimming control signal, so that the driving circuit adjusts the luminance of the light emitting diode string to a second luminance which is different from the first luminance according to the first control signal.

In an embodiment of the invention, since the light emitting diode driving apparatus includes the complex function pin coupled to the backlight control circuit, so the control current generating unit receives the dimming control signal and the enable control signal via the complex function pin.

In an embodiment of the invention, the backlight control circuit further includes an input resistor and an input diode. A first terminal of the input resistor receives the dimming control signal, and a second terminal of the input resistor is coupled to the control current generating unit via the complex function pin. A cathode terminal of the input diode receives the enable control signal, and an anode terminal of the input diode is coupled to the control current generating unit via the complex function pin.

The light emitting diode backlight system of the invention includes at least one light emitting diode string and a light emitting diode driving apparatus. The light emitting diode driving apparatus is configured to drive the light emitting diode string, in which the light emitting diode driving apparatus includes a driving circuit and a backlight control circuit. The driving circuit is coupled to the light emitting diode string and configured to provide a driving signal to drive the light emitting diode string. The backlight control circuit is coupled to a circuit complex function pin and a driving circuit. The backlight control circuit includes a control current generating unit, a first current comparing unit and a second current comparing unit. The control current generating unit receives a dimming control signal and an enable control signal from the complex function pin, and generates a control current in response to disable/enable states of the dimming control signal and the enable control signal. The first current comparing unit is coupled to the control current generating unit, and configured to compare the control current with a first predetermined current and generate a first control signal according to a comparison result. The second current comparing unit is coupled to the control current generating unit, and configured to compare the control current with a second predetermined current and generate a second control signal according to a comparison result, in which the first predetermined current is less than the second predetermined current. The driving circuit determines to be turned on or off according to the second control signal, so as to control whether to provide the driving signal. The driving circuit further adjusts the driving signal according to the first control signal, so as to adjust a luminance of the light emitting diode string.

Based on above, a light emitting diode driving apparatus and a light emitting diode backlight system using the same are provided according to the embodiments of the invention. In the light emitting diode driving apparatus, a backlight control circuit may generate different control signals respectively according to disable/enable states of a dimming control signal and an enable control signal received, so that the backlight control circuit may control the driving circuit by determining a current size, and the driving circuit may determine to be turned on or off according to a determined result and adjust a luminance of the light emitting diode. Accordingly, the light emitting diode driving apparatus and the backlight system which are applied with said backlight control circuit may receive two different control signals via only one single complex function pin, so as to effectively simplify overall circuit design of the light emitting diode driving apparatus and the backlight system.

To make the above features and advantages of the invention more comprehensible, several embodiments accompanied with drawings are described in detail as follows.

DESCRIPTION OF THE EMBODIMENTS

Figure 1:
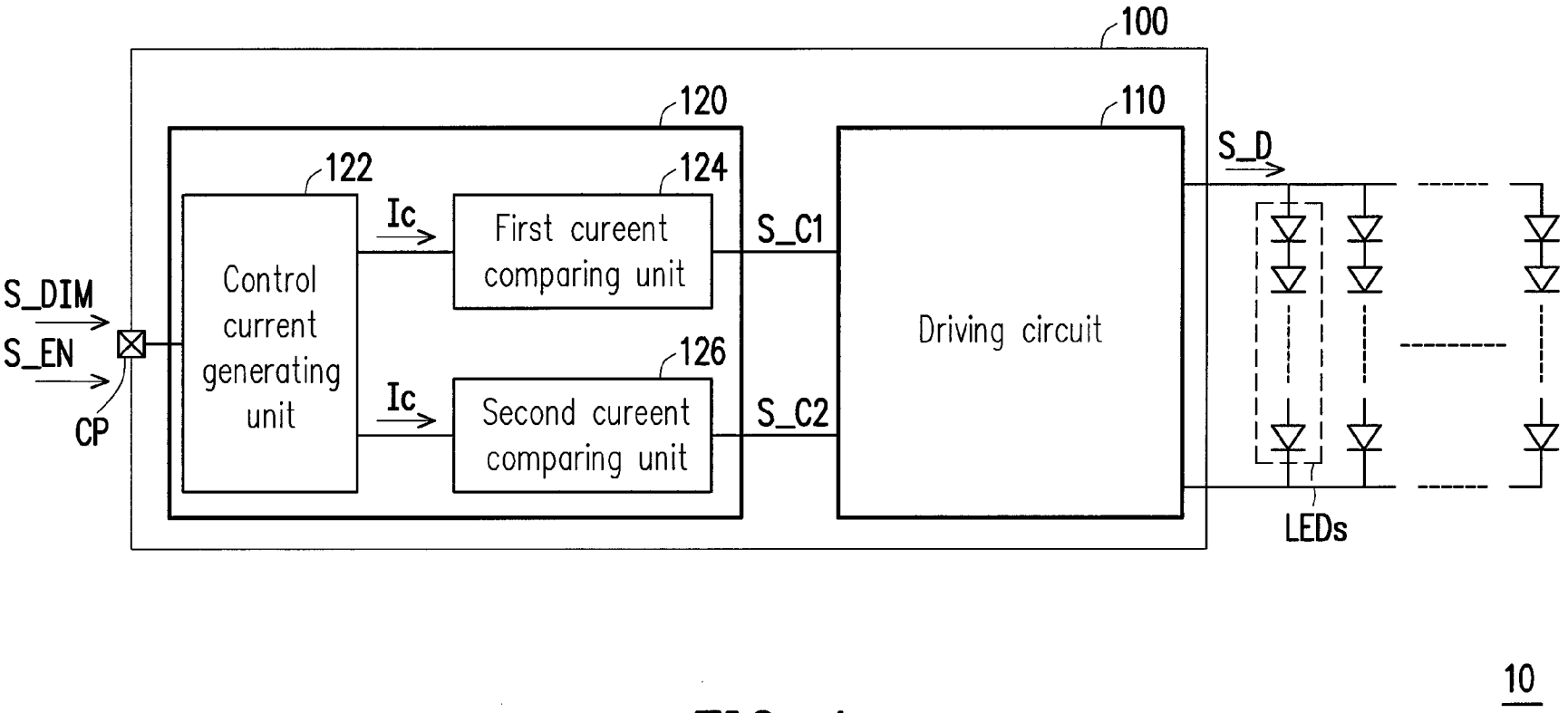
FIG. 1 is a schematic diagram of a light emitting diode backlight system according to an embodiment of the invention.

According to embodiments of the invention, a light emitting diode driving apparatus and a light emitting diode backlight system using the same are provided. In the light emitting diode driving apparatus, a backlight control circuit may generate different control signals respectively according to disable/enable states of a dimming control signal and an enable control signal received, so that the backlight control circuit may control the driving circuit by determining a current size, and the driving circuit may determine to be turned on or off according to a determined result and adjust a luminance of the light emitting diode. Accordingly, the light emitting diode driving apparatus and the backlight system which are applied with said backlight control circuit may receive two different control signals via only one single complex function pin, so as to effectively simplify overall circuit design of the light emitting diode driving apparatus and the backlight system. In order to make content of the present disclosure more comprehensible, embodiments are described below as the examples to prove that the present disclosure can actually be realized. Moreover, elements/components/steps with same reference numerals represent same or similar parts in the drawings and embodiments.

FIG. 1 is a schematic diagram of a light emitting diode backlight system according to an embodiment of the invention. Referring to FIG. 1, a light emitting diode backlight system 10 includes a light emitting diode string LEDs and a light emitting diode driving apparatus 100 for driving the light emitting diode string LEDs, in which the light emitting diode string LEDs may be of one set or multiple sets interconnected in parallel, and each light emitting diode string LEDs may include one light emitting diode or multiple light emitting diodes interconnected in series, but the invention is not limited thereto.

The light emitting diode driving apparatus 100 includes a driving circuit 110 and a backlight control circuit 120. The driving circuit 110 is coupled to the light emitting diode string LEDs and configured to provide a driving signal S_D to drive the light emitting diode string LEDs. More specifically, the driving circuit 110 includes, for example, a power switch (not illustrated) and a power conversion circuit (not illustrated), in which the driving circuit 110 may provide a switching signal (e.g., a pulse-width modulation (PWM) signal) to switch a conducting state of the power switch, so that the power conversion circuit may generate the driving signal S_D (which may be a specific driving current) in response to switching of the power switch, so as to turn on the light emitting diode string LEDs in response to the driving signal S_D for emitting light.

The backlight control circuit 120 is coupled to the driving circuit 110, in which the backlight control circuit 120 includes a control current generating unit 122, a first current comparing unit 124 and a second current comparing unit 126. The control current generating unit 122 may generate a corresponding control current $I_C$ in response to disable/enable states of dimming control signal S_DIM and an enable control signal S_EN. The first current comparing unit 124 is coupled to the control current generating unit 122, in which the first current comparing unit 124 is configured to compare the control current $I_C$ with a first predetermined current and generate a first control signal S_C1 according to the comparison result. The second current comparing unit 126 is coupled to the control current generating unit 122, in which the second current comparing unit 126 is configured to compare the control current $I_C$ with a second predetermined current and generate a second control signal S_C2 according to the comparison result. In the present embodiment, the first predetermined current is less than the second predetermined current.

More specifically, the backlight control circuit 120 generates the first control signal S_C1 and the second control signal S_C2 to the driving circuit 110 respectively according to the dimming control signal S_DIM and the enable control signal S_EN received by a complex function pin CP, so that the driving circuit 110 may determine to be turned on or off according to the second control signal S_C2 so as to control whether to turn on the light emitting diode LEDs; and when being turned on by the second control signal S_C2, the driving circuit 110 may further control a luminance of the light emitting diode string LEDs according to the first control signal S_C1.

In the present embodiment, the driving circuit 110 and the backlight control circuit 120 including the control current generating unit 122, a first current comparing unit 124 and the second current comparing unit 126 may be integrated into one control chip. In the integrated circuit layout of the control chip, the backlight control circuit 120 controls the driving circuit 110 by providing the corresponding control signal according to the control current, meanwhile, the control current is generated on a basis of the disable/enable states of the enable control signal S_EN and the dimming control signal S_DIM. Therefore, the control chip may receive two control signals (the dimming control signal S_DIM and the enable control signal S_EN) at the same time via only one single complex function pin CP being disposed, and then perform corresponding control actions, so as to significantly lower the complicity in integration design.

Figure 2:
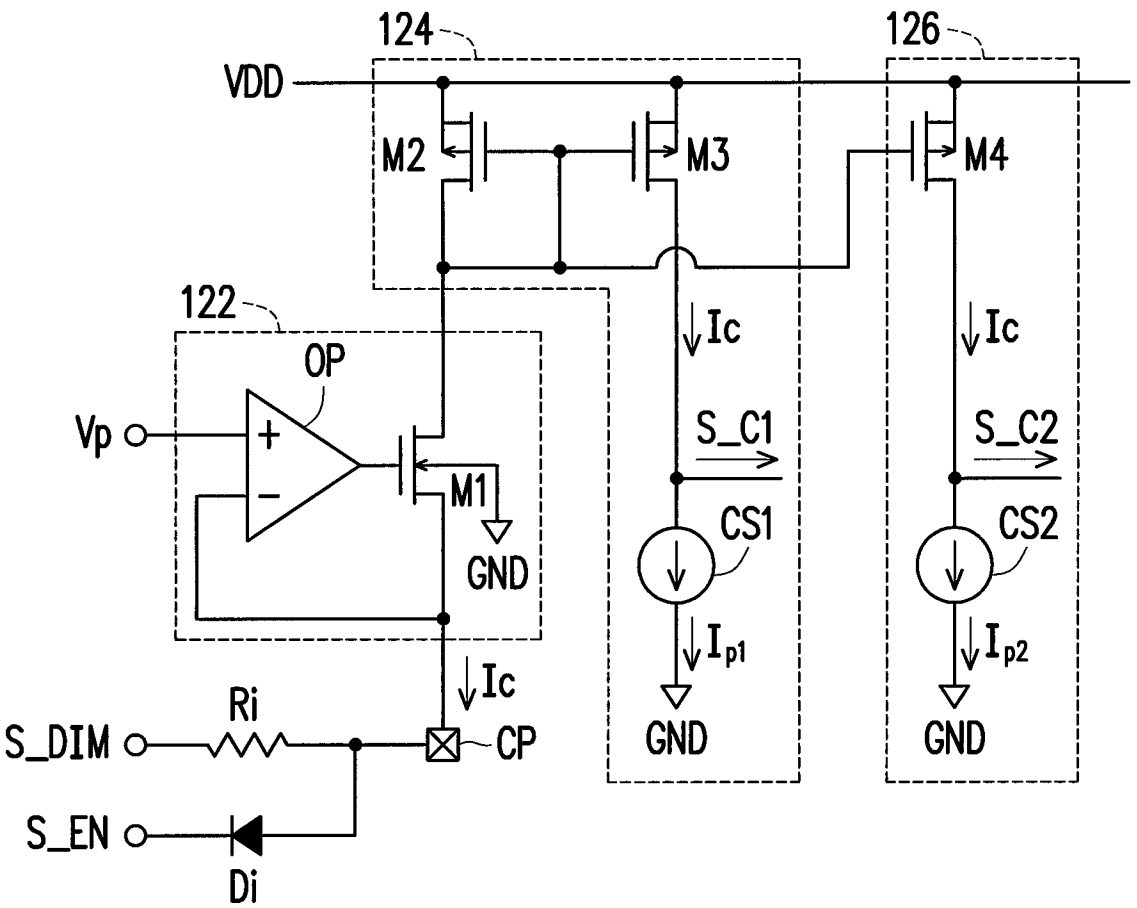
FIG. 2 is a schematic circuit diagram of a backlight control circuit according to an embodiment of the invention.

To explain the present embodiment of the invention more clearly, referring to FIG. 2 which is a schematic circuit diagram of a backlight control circuit according to an embodiment of the invention. Referring to FIG. 2, in the present embodiment, the control current generating unit 122 includes an operational amplifier OP and a transistor M1, and the first current comparing unit 124 includes transistors M2 and M3 and a current source CS1, and the second current comparing unit 126 includes a transistor M4 and a current source CS2. Among which, the transistor M1 is, for example, an N-type transistor; and the transistors M2 to M4 is, for example, P-type transistors, but the invention is not limited thereto.

More specifically, the backlight control circuit 120 further includes an input resistor Ri and an input diode Di. A first terminal of the input resistor Ri receives the dimming control signal S_DIM, and a second terminal of the input resistor Ri is coupled to the control current generating unit 122 via the complex function pin CP. A cathode terminal of the input diode Di receives the enable control signal S_EN, and an anode terminal of the input diode Di is coupled to the control current generating unit 122 via the complex function pin CP.

The operational amplifier OP includes a first input terminal coupled to a predetermined voltage Vp. A gate of the transistor M1 is coupled to an output terminal of the operational amplifier OP, and a source of the transistor M1 is coupled to a second input terminal of the operational amplifier OP, the second terminal of the input resistor Ri and the anode terminal of the input diode Di. A gate and a drain of the transistor M2 is coupled to a drain of the transistor M1, and a source of the transistor M2 is coupled to a power voltage VDD. A gate of the transistor M3 is coupled to the gate of the transistor M2, and a source of the transistor M3 is coupled to the power voltage VDD. The current source CS1 is coupled between a drain of the transistor M3 and a grounding voltage GND, in which the current source CS1 is configured to provide a first predetermined current $I_{P1}$. A gate of the transistor M4 is coupled to the gate of the transistor M2, and a source of the transistor M4 is coupled to the power voltage VDD. The current source CS2 is coupled between a drain of the transistor M4 and the grounding voltage GND, in which the current source CS2 is configured to provide a second predetermined current $I_{P2}$.

In the present embodiment, the dimming control signal S_DIM and the enable control signal S_EN are provided, respectively, to the second input terminal of the operational amplifier OP and the source of the transistor M1 via the complex function pin CP, thus the operational amplifier OP may determine whether to turn on the transistor M1 according to the disable/enable states of the dimming control signal S_DIM and the enable control signal S_EN. In addition, since the dimming control signal S_DIM and the enable control signal S_EN are fed in the control current generating unit 122 by different impedance components (the input resistor Ri and the input diode Di), respectively, when the transistor M1 is turned on in response to the control signals S_DIM or S_EN, a conductive level of the transistor M1 may be varied according to different control signals S_DIM or S_EN, so that the transistor M1 may generate the control current $I_C$ in various magnitudes.

More specifically, the predetermined voltage Vp (e.g., 1V) received by the operational amplifier OP is set to be greater than a forward conducting bias of the input diode Di (e.g., 0.7V). When the enable control signal S_EN is disabled (e.g., at low voltage level), the input diode Di is turned on in response to a voltage difference between the cathode terminal and the anode terminal, so that the operational amplifier OP may output a signal with high voltage level to turn on the transistor M1, so as to generate the corresponding control current $I_C$ (meanwhile, the control current $I_C$ is greater than or equal to the second predetermined current $I_{P2}$). In this case, the control current $I_C$ generated by the transistor M1 is mapped to current paths of the transistors M3 and M4, respectively via a current mirror composed by the transistors M2 and M3 and a current mirror composed by the transistors M2 and M4, and so as to be compared with the first predetermined current $I_{P1}$ provided by the current source CS1 and the second predetermined current $I_{P2}$ provided by the current source CS2, respectively. In case that the enable control signal S_EN is disabled, the second current comparing unit 126 generates the second control signal S_C2 corresponding to the control current $I_C$ which is greater than or equal to the second predetermined current $I_{p2}$, so that the driving circuit 110 is turned off according to the second control signal S_C2 and stops to provide the driving signal S_D to turn off the light emitting diode string LEDs.

On the other hand, when the enable control signal S_EN is enabled (e.g., at high voltage level), the input diode Di is turned/cut off in response to the voltage difference between the cathode terminal and the anode terminal, in this case, whether to turn on the transistor M1 is mainly determined by the disable/enable state of the dimming control signal S_DIM. Herein, the input resistor Ri may be set to include a specific resistance (e.g., 100,000 Ohms), so that a voltage difference between the two terminals of the input resistor Ri is greater than the forward conducting bias of the input diode Di. Therefore, regardless of whether the dimming control signal S_DIM is disabled or enabled, the control current $I_C$ generated by the transistor M1 is less than the second predetermined current $I_{P2}$.

Furthermore, in case that the enable control signal S_EN is enabled, when the dimming control signal S_DIM is disabled (e.g., at low voltage level), the operational amplifier OP may output a signal with high voltage level to turn on the transistor M1 in response to the dimming signal S_DIM being disabled, so as to generate the corresponding control current $I_C$ (meanwhile, the control current $I_C$ is greater than or equal to the first predetermined current $I_{P1}$ and less than the second predetermined current $I_{P2}$). In this case, the control current $I_C$ generated by the transistor M1 is mapped to current paths of the transistors M3 and M4, respectively via a current mirror composed by the transistors M2 and M3 and a current mirror composed by the transistors M2 and M4, and so as to be compared with the first predetermined current $I_{P1}$ and the second predetermined current $I_{P2}$, respectively. In case when the dimming signal S_DIM is disabled, the first current comparing unit 124 generates the first control signal S_C1 corresponding to the control current $I_C$ which is greater than or equal to the first predetermined current $I_{P1}$, and second current comparing unit 126 generates the second control signal S_C2 corresponding to the control current $I_C$ which is less than the second predetermined current $I_{P2}$, so that the driving circuit 110 is turned on according to the second control signal S_C2 to continuously output the driving signal S_D to turn on the light emitting diode string LEDs, and adjusts the luminance of the light emitting diode string LEDs to a first luminance according to the first control signal S_C1.

On the contrary, when the dimming control signal S_DIM is enabled (e.g., at high voltage level), the operational amplifier OP may output a signal with low voltage level in response to the dimming control signal S_DIM being enabled, so as to turn off the transistor M1. In this case, the transistor M1 stops to generate the control current $I_C$ (or generate the control current $I_C$ being OA, in which case the control current $I_C$ is less than the first predetermined current $I_{P1}$), so that the first current comparing unit 124 generates the first control signal S_C1 corresponding to the control current $I_C$ which is less than the first predetermined current $I_{P1}$, and the second current comparing unit 126 generates the second control signal S_C2 corresponding to the control current $I_C$ which is less than the second predetermined current $I_{P2}$. Therefore, the driving circuit 110 is turned on according to the second control signal S_C2 to continuously output the driving signal S_D to turn on the light emitting diode string LEDs, and adjusts the luminance of the light emitting diode string LEDs to a second luminance which is different from the first luminance according to the first control signal S_C1.

In other words, in the present embodiment, as long as the enable control signal S_EN is disabled, regardless of whether the dimming control signal S_DIM is enabled, the driving circuit 110 stops to provide the driving signal S_D according to the second control signal S_C2, so as to turn off the light emitting diode string LEDs. Moreover, in the present embodiment, the driving circuit 110 first determines whether to turn on the light emitting diode string LEDs according to the second control signal S_C2, then further determines the luminance of the light emitting diode string LEDs according to the first control signal S_C1.

In light of above, a light emitting diode driving apparatus and a light emitting diode backlight system using the same are provided according to the embodiments of the invention. In the light emitting diode driving apparatus, a backlight control circuit may generate different control signals respectively according to disable/enable states of a dimming control signal and an enable control signal received, so that the backlight control circuit may control the driving circuit by determining a current size, and the driving circuit may determine to be turned on or off according to a determined result and adjust a luminance of the light emitting diode. Accordingly, the light emitting diode driving apparatus and the backlight system which are applied with said backlight control circuit may receive two different control signals via only one single complex function pin, so as to effectively simplify overall circuit design of the light emitting diode driving apparatus and the backlight system.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light emitting diode driving apparatus suitable for driving at least one light emitting diode string, the light emitting diode driving apparatus comprising:

a complex function pin;

a driving circuit coupled to the light emitting diode string and configured to provide a driving signal to drive the light emitting diode string; and a backlight control circuit coupled to the circuit complex function pin and the driving circuit, wherein the backlight control circuit comprises:

a control current generating unit receiving a dimming control signal and an enable control signal from the complex function pin, and generating a control current in response to disable/enable states of the dimming control signal and the enable control signal;

a first current comparing unit coupled to the control current generating unit, and configured to compare the control current with a first predetermined current, so as to generate a first control signal accordingly; and a second current comparing unit coupled to the control current generating unit, and configured to compare the control current with a second predetermined current, so as to generate a second control signal accordingly, wherein the first predetermined current is less than the second predetermined current, wherein the driving circuit determines to be turned on or off according to the second control signal, so as to control whether to provide the driving signal, wherein the driving circuit further adjusts a magnitude of the driving signal according to the first control signal, so as to adjust a luminance of the light emitting diode string.

2. The light emitting diode driving apparatus of claim 1, wherein when the enable control signal is disabled, the control current generating unit generates the control current greater than or equal to the second predetermined current in response to the enable control signal, so that the driving circuit is turned off according to the second control signal and stops to provide the driving signal to turn off the light emitting diode string.

3. The light emitting diode driving apparatus of claim 1, wherein when the enable control signal is enabled, the control current generating unit generates the control current less than the second predetermined current in response to the disable/enable state of the dimming control signal, so that the driving circuit is turned on according to the second control signal and provides the driving signal to turn on the light emitting diode string.

4. The light emitting diode driving apparatus of claim 3, wherein when the dimming control signal is disabled, the control current generating unit generates the control current greater than or equal to the first predetermined current in response to the dimming control signal, so that the driving circuit adjusts the luminance of the light emitting diode string to a first luminance according to the first control signal.

5. The light emitting diode driving apparatus of claim 4, wherein when the dimming control signal is enabled, the control current generating unit generates the control current less than the first predetermined current in response to the dimming control signal, so that the driving circuit adjusts the luminance of the light emitting diode string to a second luminance which is different from the first luminance according to the first control signal.

6. The light emitting diode driving apparatus of claim 1, wherein the backlight control circuit further comprises:

an input resistor having a first terminal receiving the dimming control signal, and a second terminal coupled to the control current generating unit via the complex function pin; and an input diode having a cathode terminal receiving the enable control signal, and an anode terminal coupled to the control current generating unit via the complex function pin.

7. The light emitting diode driving apparatus of claim 6, wherein the control current generating unit comprises:

an operational amplifier having a first input terminal coupled to a predetermined voltage; and a first transistor having a gate coupled to an output terminal of the operational amplifier, and a second source/drain coupled to a second input terminal of the operational amplifier, the second terminal of the input resistor and the anode terminal of the input diode.

8. The light emitting diode driving apparatus of claim 7, wherein the first current comparing unit comprises:

a second transistor having a gate and a first source/drain coupled to a first source/drain of the first transistor, and a second source/drain coupled to a power voltage;

a third transistor having a gate coupled to the gate of the second transistor, and a second source/drain coupled to the power voltage; and a first current source coupled between a first source/drain of the third transistor and a grounding voltage, and configured to provide the first predetermined current.

9. The light emitting diode driving apparatus of claim 8, wherein the second current comparing unit comprises:

a fourth transistor having a gate coupled to the gate of the second transistor, and a second source/drain coupled to the power voltage; and a second current source coupled between a first source/drain of the fourth transistor and the grounding voltage, and configured to provide the second predetermined current.

10. A light emitting diode backlight system, comprising:

at least one light emitting diode string; and a light emitting diode driving apparatus configured to drive the light emitting diode string, wherein the light emitting diode driving apparatus comprises a complex function pin, a driving circuit coupled to the light emitting diode string and configured to provide a driving signal to drive the light emitting diode string, and a backlight control circuit coupled to the circuit complex function pin and the driving circuit, wherein the backlight control circuit comprises:

a control current generating unit receiving a dimming control signal and an enable control signal from the complex function pin, and generating a control current in response to disable/enable states of the dimming control signal and the enable control signal;

a first current comparing unit coupled to the control current generating unit, and configured to compare the control current with a first predetermined current, so as to generate a first control signal accordingly; and a second current comparing unit coupled to the control current generating unit, and configured to compare the control current with a second predetermined current, so as to generate a second control signal accordingly, wherein the first predetermined current is less than the second predetermined current, wherein the driving circuit determines whether to provide the driving signal according to the second control signal, so as to control a conducting state of the light emitting diode string, wherein the driving circuit further adjusts a magnitude of the driving signal according to the first control signal, so as to adjust a luminance of the light emitting diode string.

11. The light emitting diode backlight system of claim 10, wherein when the enable control signal is disabled, the control current generating unit generates the control current greater than or equal to the second predetermined current in response to the enable control signal, so that the driving circuit is turned off according to the second control signal and stops to provide the driving signal to turn off the light emitting diode string.

12. The light emitting diode backlight system of claim 10, wherein when the enable control signal is enabled, the control current generating unit generates the control current less than the second predetermined current in response to the disable/enable state of the dimming control signal, so that the driving circuit is turned on according to the second control signal and provides the driving signal to turn on the light emitting diode string.

13. The light emitting diode backlight system of claim 12, wherein when the dimming control signal is disabled, the control current generating unit generates the control current greater than or equal to the first predetermined current in response to the dimming control signal, so that the driving circuit adjusts the luminance of the light emitting diode string to a first luminance according to the first control signal.

14. The light emitting diode backlight system of claim 13, wherein when the dimming control signal is enabled, the control current generating unit generates the control current less than the first predetermined current in response to the dimming control signal, so that the driving circuit adjusts the luminance of the light emitting diode string to a second luminance which is different from the first luminance according to the first control signal.

15. The light emitting diode backlight system of claim 10, wherein the backlight control circuit further comprises:

an input resistor having a first terminal receiving the dimming control signal, and a second terminal coupled to the control current generating unit via the complex function pin; and an input diode having a cathode terminal receiving the enable control signal, and an anode terminal coupled to the control current generating unit via the complex function pin.

16. The light emitting diode backlight system of claim 15, wherein the control current generating unit comprises:

an operational amplifier having a first input terminal coupled to a predetermined voltage; and a first transistor having a gate coupled to an output terminal of the operational amplifier, and a second source/drain coupled to a second input terminal of the operational amplifier, the second terminal of the input resistor and the anode terminal of the input diode.

17. The light emitting diode backlight system of claim 16, wherein the first current comparing unit comprises:

a second transistor having a gate and a first source/drain coupled to a first source/drain of the first transistor, and a second source/drain coupled to a power voltage;

a third transistor having a gate coupled to the gate of the second transistor, and a second source/drain coupled to the power voltage; and a first current source coupled between a first source/drain of the third transistor and a grounding voltage, and configured to provide the first predetermined current.

18. The light emitting diode backlight system of claim 17, wherein the second current comparing unit comprises:

a fourth transistor having a gate coupled to the gate of the second transistor, and a second source/drain coupled to the power voltage; and a second current source coupled between a first source/drain of the fourth transistor and the grounding voltage, and configured to provide the second predetermined current.

* * * * *